US010746392B1

(12) United States Patent
Wu

(10) Patent No.: US 10,746,392 B1
(45) Date of Patent: Aug. 18, 2020

(54) LIGHTING FIXTURE

(71) Applicant: Huizhou Hanxing Optoelectronic Co., Ltd, Huizhou (CN)

(72) Inventor: Hongge Wu, Huizhou (CN)

(73) Assignee: HUIZHOU HANXING OPTOELECTRONICS CO., LTD., Huizhou (CN)

( * ) Notice: Subject to any disclaimer, the term of this patent is extended or adjusted under 35 U.S.C. 154(b) by 0 days.

(21) Appl. No.: 16/450,975

(22) Filed: Jun. 24, 2019

(30) Foreign Application Priority Data

May 31, 2019 (CN) ..... 2019 1 0470335

(51) Int. Cl.

| | |
|---|---|
| ***F21V 31/00*** | (2006.01) |
| ***F21V 29/70*** | (2015.01) |
| ***F21V 17/12*** | (2006.01) |
| ***F21V 23/00*** | (2015.01) |
| ***F21Y 105/12*** | (2016.01) |
| ***F21V 5/00*** | (2018.01) |
| *F21W 131/10* | (2006.01) |

(52) U.S. Cl.
CPC ..... *F21V 31/005* (2013.01); *F21V 5/007* (2013.01); *F21V 17/12* (2013.01); *F21V 23/002* (2013.01); *F21V 29/70* (2015.01); *F21W 2131/10* (2013.01); *F21Y 2105/12* (2016.08)

(58) Field of Classification Search
CPC ..... F21V 17/15; F21V 23/002; F21V 29/70; F21V 31/005; F21V 5/007
See application file for complete search history.

(56) References Cited

U.S. PATENT DOCUMENTS

| | | | | |
|---|---|---|---|---|
| 9,605,819 | B2 | 3/2017 | Jiang | |
| D791,983 | S | 7/2017 | Gan | |
| 2005/0225959 | A1* | 10/2005 | Pohlert | H04N 5/2354 362/3 |
| 2009/0196038 | A1* | 8/2009 | Vargas Maciel | F21V 29/507 362/249.03 |
| 2009/0237930 | A1* | 9/2009 | Li | F21S 8/086 362/235 |
| 2010/0315252 | A1* | 12/2010 | Desphande | F21S 8/088 340/670 |

(Continued)

FOREIGN PATENT DOCUMENTS

| | | | |
|---|---|---|---|
| CN | 103836464 | A | 6/2014 |
| CN | 105180046 | A | 12/2015 |

*Primary Examiner* — Leah Simone Macchiarolo
(74) *Attorney, Agent, or Firm* — Hemisphere Law, PLLC; Zhigang Ma

(57) ABSTRACT

A lighting fixture includes a bracket and at least one light source module assembled on an inner side of the bracket. Each light source module includes a radiator, a circuit board, a cover plate and a fixture assembly. A plurality of light sources are arranged on one side of the circuit board, the other side of the circuit board contacts the radiator, the cover plate is provided with a plurality of optical lenses, and the fixture assembly is connected with the radiator to press the cover plate against the radiator in a manner that the cover plate is uniformly stressed on its periphery. Therefore, with no stress concentration on the cover plate, and even if the cover plate becomes brittle and prone to cracking in a salt fog or alkali fog environment for a long time, the cover plate won't really crack.

18 Claims, 5 Drawing Sheets

(56) References Cited

U.S. PATENT DOCUMENTS

| | | | | |
|---|---|---|---|---|
| 2011/0188241 | A1* | 8/2011 | Walczak | F21V 5/00 362/235 |
| 2011/0304270 | A1* | 12/2011 | Scarpelli | F21V 29/507 315/113 |
| 2012/0075859 | A1* | 3/2012 | Granado | F21V 29/89 362/249.02 |
| 2012/0106162 | A1* | 5/2012 | Lin | F21V 23/008 362/294 |
| 2012/0127727 | A1* | 5/2012 | Wan-Chih | F21V 29/74 362/294 |
| 2013/0070455 | A1* | 3/2013 | Tsui | F21V 5/002 362/235 |
| 2015/0022094 | A1* | 1/2015 | Hayman | F21V 7/005 315/152 |
| 2015/0128409 | A1* | 5/2015 | Chen | F21V 27/02 29/829 |
| 2016/0076748 | A1* | 3/2016 | Sievers | H05B 45/20 362/231 |
| 2017/0373483 | A1* | 12/2017 | Chen | H01R 13/5205 |
| 2020/0182452 | A1* | 6/2020 | Ter-Hovhannisyan | F21V 15/01 |

* cited by examiner

LIGHTING FIXTURE

CROSS-REFERENCE TO RELATED APPLICATION

This application claims priority benefit of Chinese Application 201910470335.2, filed on May 31, 2019, said application being fully incorporated by reference herein.

BACKGROUND OF THE INVENTION

1. Technical Field

The invention relates to lighting fixtures, in particular to a lighting fixture suitable for outdoor use.

2. Description of Related Art

A lighting fixture suitable for outdoor use requires strictly on waterproof performance, which means a circuit board and a light source have to be fixed in a sealed-up space. A commonly used lampshade is generally made of a plastic material, such as polycarbonate (commonly referred to as PC), and is fixed on a bracket through a plurality of screws, for example, a main illumination light source shade of a Chinese invention patent with a patent application number of 201410074606. X and a filing date of Mar. 3, 2014 is fixed on a first main heat dissipation body through a plurality of screws. However, common plastic materials such as PC materials are easy to become brittle and to crack in a salt fog or alkali fog environment, the surface of the lampshade, particularly the periphery of the screw hole, is stressed unevenly when a plurality of screws are used for fixing the lampshade, and under stress for a long time in use, the lampshade may crack or even break inevitably, the sealing of the lamp fails, causing a great loss of service life.

BRIEF DESCRIPTION OF THE SEVERAL VIEWS OF THE DRAWINGS

The foregoing and other exemplary purposes, aspects and advantages of the present invention will be better understood in principle from the following detailed description of one or more exemplary embodiments of the invention with reference to the drawings, in which.

DETAILED DESCRIPTION OF THE INVENTION

The invention will now be described in detail through several embodiments with reference to the accompanying drawings.

Figure 1:
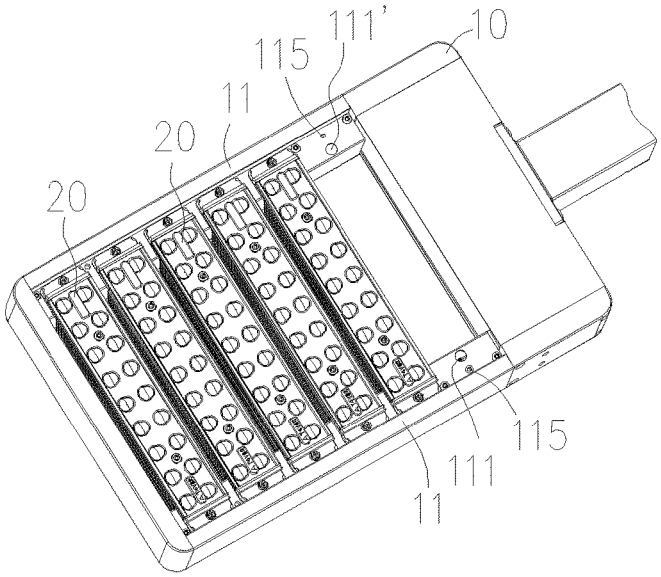
FIG. 1 is a perspective view of a lighting fixture in accordance with a first embodiment of the invention, wherein one of the light source modules of the lighting fixture is removed.

With reference to FIG. 1, in a first embodiment, the lighting fixture of the present invention mainly includes a bracket 10 and several light source modules 20 assembled on an inner side of the bracket 10. The lighting fixture shown in FIG. 1 includes six light source modules, one light source module 20 is removed for ease of viewing the bracket 10. The light source modules 20 are modular and can be arranged between two fixing pipes 11 of the bracket 10 in parallel, and lighting fixtures with different sizes and different powers can be formed by arranging different numbers of light source modules. The structure and function of the light source module 20 will be described in detail below.

Figure 2:
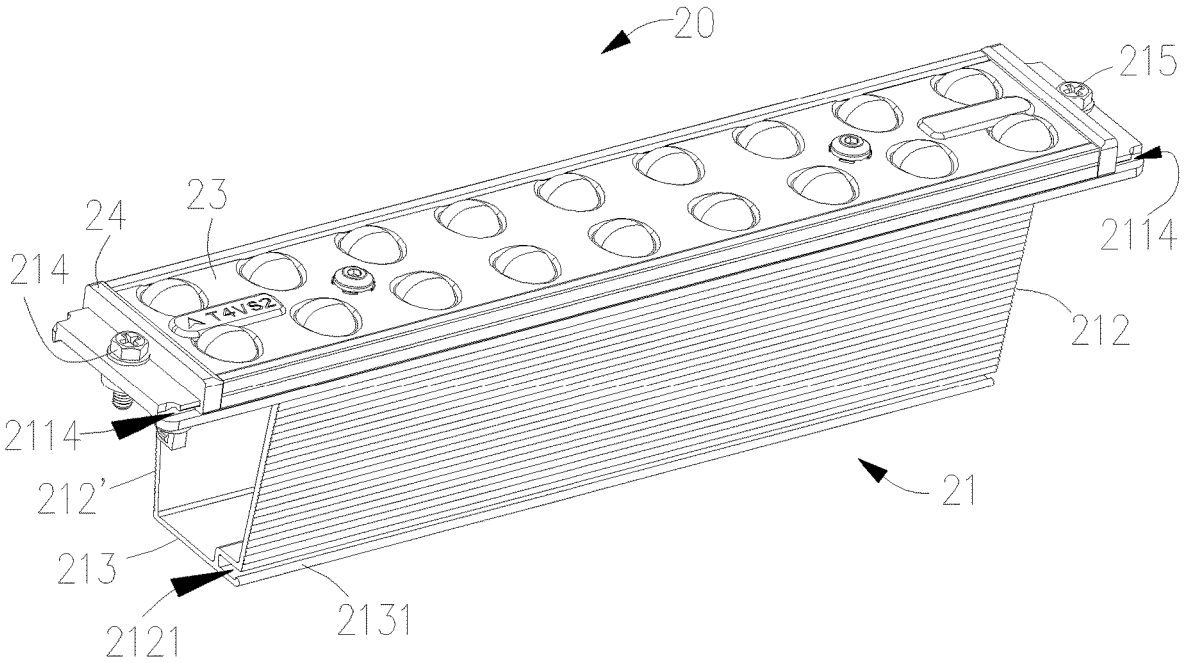
FIG. 2 is a perspective view of the light source module which is removed from FIG. 1.
Figure 3:
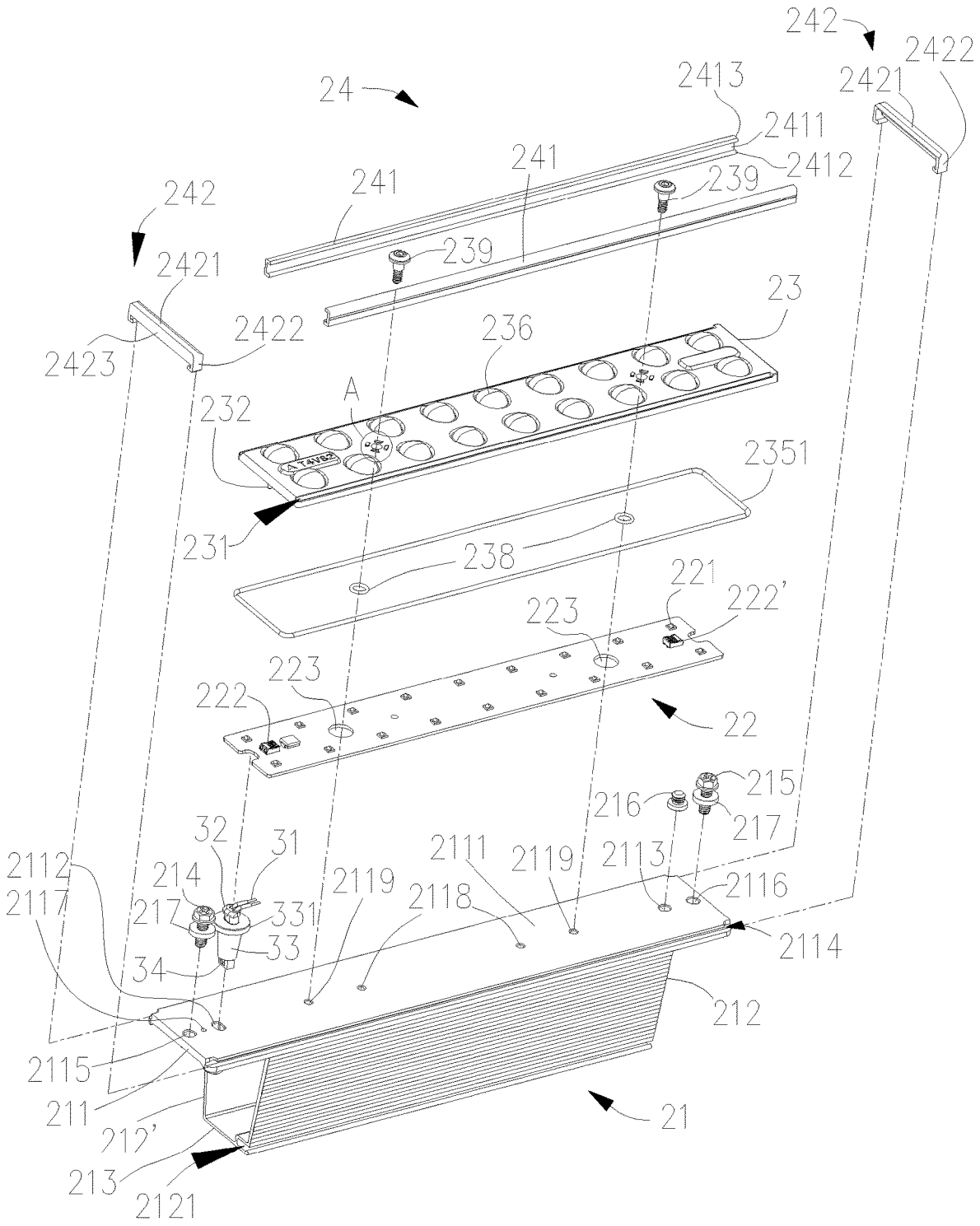
FIG. 3 is an exploded view of the light source module of FIG. 2.

With reference to FIGS. 2 and 3 at the same time, the light source module 20 mainly includes a radiator 21, a circuit board 22 having one side in contact with the radiator 21, a cover plate 23, and a fixture assembly 24. The fixture assembly 24 is connected with the radiator 21, so that the cover plate 23 is pressed against the radiator 21 in a manner that the cover plate is uniformly stressed on its periphery by the fixture assembly 24.

To facilitate description, a side from which light is transmitted of the lighting fixture is defined to be forward/front, and a side facing away from the light transmitting direction is defined to be back/rear hereinafter.

The radiator 21 has a flat fixing surface 2111. Specifically, in the present embodiment, the radiator 21 is mainly made of an aluminum profile having a certain degree of bending, and includes a substantially rectangular first heat transfer plate 211 having a flat fixing surface 2111, and two second heat transfer plates 212, 212' integrally extending from both sides (with reference to the long sides, in other words the lengths of the first heat transfer plate) of the back surface of the first heat transfer plate 211, and a third heat transfer plate 213 connecting the ends of the two second heat transfer plates. The outer surfaces of the second heat transfer plates 212, 212' are wavy, and the lengths of the second heat transfer plates 212, 212' and the third heat transfer plate 213 are smaller than that of the first heat transfer plate 211, so that the third heat transfer plate 213 covers a portion of the first heat transfer plate 211 with both ends of the first heat transfer plate 211 featuring protruding out of the radiator 21 as viewed from the rear surface perpendicular to the first heat transfer plate. Wire holes 2112, 2113 and fixing holes 2115, 2116 which are positioned even closer to the outer side relative to the wire holes 2112, 2113 are respectively formed on both end portions of the first heat transfer plate 211 protruding beyond relative to the second heat transfer plates and the third heat transfer plate, wherein the wire hole 2112 and the fixing hole 2115 are located at one protruding end of the first heat transfer plate 211, and the wire hole 2113 and the fixing hole 2116 are located at the other protruding end of the first heat transfer plate 211. A positioning hole (or a positioning pit) 2117 is also formed between the wire hole 2113 and the fixing hole 2116. At least one positioning hole 2118 (or positioning pit) and two screw holes 2119 are also formed in the fixing surface 2111 of the first heat transfer plate 211 in the part where the first heat transfer plate 211 does not protrude beyond relative to the second heat transfer plates and the third heat transfer plate.

Each of the two side walls as long sides (lengths) of the first heat transfer plate 211 defines a sliding slot 2114 with both ends open. Specifically, the sliding slot 2114 is recessed from the side wall of the first heat transfer plate 211 toward the opposite other side wall, and extends through the entire side wall in a direction in which the long side of the first heat transfer plate extends.

Figure 4:
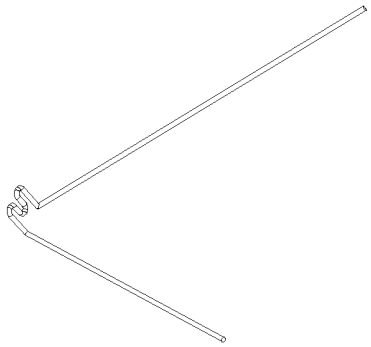
FIG. 4 is a schematic view showing the structure of a bird-proof member according to an embodiment.

In particular, a groove 2121 is defined at or near a long side (length) of one of the second heat transfer plates 212 where the third heat transfer plate 213 is joined, for detachably fixing one or more bird-proof members as shown in FIG. 4. The bird-proof members may be formed by bending a metal wire, and may have an elastic portion insertable into and clamped in the groove 2121 and a straight portion extending from the elastic portion toward the rear of the radiator. More specifically, a long side (length) 2131 of the third heat transfer plate 213 is slightly bent toward the first heat transfer plate 211 to form a hook portion, and the second heat transfer plate 212 extends from the side of the rear surface of the first heat transfer plate 211 toward the long side 2131 of the third heat transfer plate 213, and is bent at a predetermined distance from the third heat transfer plate 213, for example, 0.8 to 3 cm, extends toward the second heat transfer plate 212', for example, but not limited to, 0.5 to 5 cm, and then is bent and extends towards the third heat transfer plate 213, and finally is connected to the third heat transfer plate 213 at a position near its long side 2131, so that the groove 2121 is formed in the second heat transfer plate 212, which is recessed towards the second heat transfer plate 212' and extends along the long side of the second heat transfer plate 212 (and also along the long side 2131). The groove 2121 of this structure does not destroy the structural integrity of the backside of the radiator. Under the condition that the radiator is favorable for improving the heat dissipation efficiency and enhancing the strength of the radiator, dust, leaves, sand and feces can be effectively prevented from accumulating in the long run on the back surface of the radiator. When a plurality of light source modules are assembled, gaps are reserved among the plurality of light source modules 20, convection spaces are formed among the different light source modules 20 in the gaps, and air is allowed to enter between the second heat transfer plates, so that heat on the second heat transfer plates and the third heat transfer plates can be directly taken away by convection generated by the air due to the stack effect that hot air rises and cold air supplements, and the heat dissipation effect is improved. In addition, the wavy patterns on the second heat transfer plate increase the effective heat dissipation area of the heat transfer plate, and the heat dissipation efficiency is higher.

Figure 5:
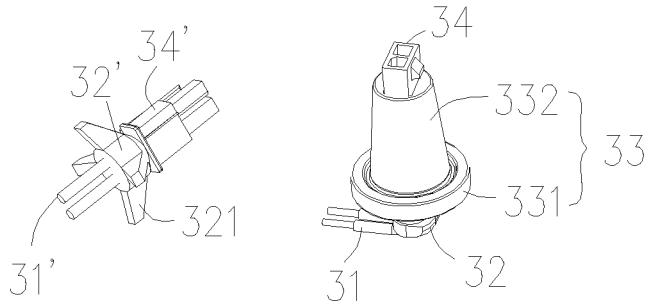
FIG. 5 is a schematic view showing a structure of a power interface, for realizing electrical connection, on a bracket and a light source module of a lighting fixture in the first embodiment.

One surface (rear/back surface) of the circuit board 22 is in contact with (clings to) the fixing surface 2111 of the radiator 21, and the other surface (front surface) is provided with a plurality of light sources 221. In this embodiment, the circuit board 22 is generally (substantially or approximately, as determined by a person of ordinary skill in the art) in a rectangular shape having a width and a length smaller than those of the fixing surface 2111 of the first heat transfer plate 211. The two ends of the circuit board 22 (near the short sides/widths thereof) are further provided with power wiring terminals 222, 222', respectively, which are electrically connected to the wires in the circuit board. Wire holes 2112, 2113 in the first heat transfer plate 211 of the radiator 21 are close to the power wiring terminals 222, 222'. A sealing rubber seat 32 which is matched with the shape of the wire hole 2112 is sleeved on the power wire 31 for supplying power to the light source 221, one end of the power wire 31 is connected with the power wiring terminal 222, the other end of the power wire 31 is connected with a first electric connector 34. The sealing rubber seat 32 is inserted into the wire hole 2112 and seals a gap between the wire hole 2112 and the power wire 31. A guide rubber seat 33 is further fixed on the power wire 31 and is located between the first electric connector 34 and the sealing rubber seat 32. The guide rubber seat 33 includes a cylinder 332 and a trim 331 extending outwardly from an end of the cylinder away from the first electrical connector 34 (also the end adjacent to the seal seat 32). The size of one end of the cylinder 332 near the first electrical connector 34 is smaller than the size of the wire hole 111 of the bracket 10, and the size of one end of the cylinder 332 near the trim is equal to or larger than the size of the wire hole 111. In this embodiment, the cylinder 332 has a shape in which the periphery is gradually enlarged from the end to the direction of the trim 331, and the outer circumference of the rubber seat 33 near the trim 331 is larger than the size of the wire hole 111 of the bracket 10. With reference to FIGS. 1 and 5 at the same time, the fixing pipes 11 of the bracket 10 are formed with wire holes 111,111' corresponding to the wire holes 2112 of the radiator 21, and the size of the wire hole 111 of the bracket 10 is smaller than that of the trim 331. The end of the power wire 31' in the bracket 10 is connected to a second electrical connector 34', and a rubber block 32' is fixed on the power wire 31' near the second electrical connector 34', and a plurality of fingers 321 extending to the outside and away from the second electrical connector are formed on the outer peripheral wall of the rubber block 32'. The plurality of fingers are formed to be a claw. Preferably, the rubber block 32' and the finger 321 are made of a silica gel material, the outer circumferential dimension of the rubber block is smaller than or equal to the dimension of the wire hole 111 of the bracket 10, the dimension of the finger 321 extending outward is larger than the dimension of the wire hole 111 of the bracket, and the rubber block and the finger can pass through the wire hole 111 under the action of an external force. The second electrical connector 34' is sized so that it can pass through the wire hole 111. Therefore, before the light source module 20 is fixed on the bracket 10, the second electric connector 34' is kept exposed outside the bracket 10 by pulling the second electric connector 34' and the rubber block 32' out of the wire hole 111, and after the first electric connector 34 and the second electric connector 34' are connected, the guide rubber seat 33 is inserted into the wire hole 111 because the finger 321 is made of soft silica gel and can be plugged into the wire hole 111, so that the wire hole 111 is sealed, and meanwhile, the power wire 31' can be prevented from being squeezed between the radiator 21 and the bracket 10 in the assembling process. Preferably, the end portion of the rubber block 32' abuts against the end portion of the second electrical connector 34' to prevent the power wire from being bent therebetween. The end part of the guide rubber seat 33 is sleeved on the periphery of one end of the first electric connector 34, so that the power wire between the first electric connector 34 and the second electric connector 34 is prevented from being bent. A through hole is formed in the circuit board 22 at a position opposite to the wire holes 2112, 2113, the fixing holes 2115, 2116, the positioning hole 2118 and the screw hole 2119 on the radiator, wherein the size of the through hole 223 opposite to the screw hole 2119 is larger than the inner diameter of the screw hole 2119.

Figure 6:
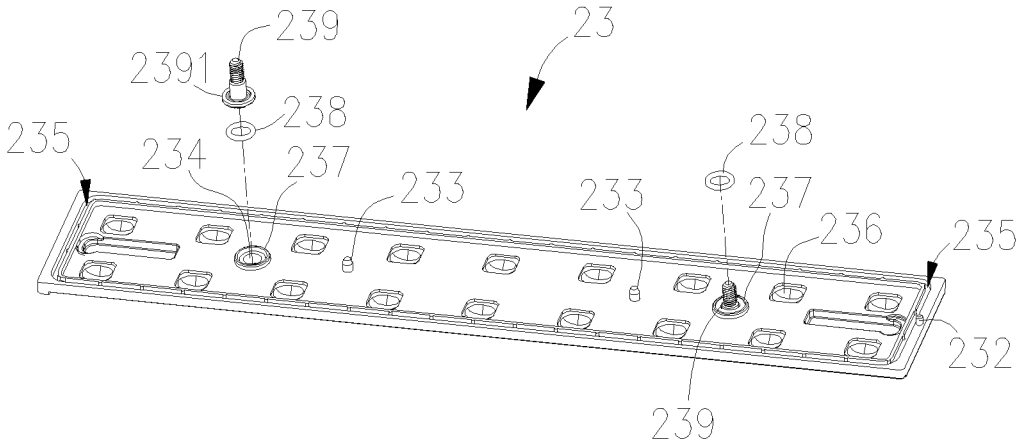
FIG. 6 is a perspective view from the rear side of the cover plate and screw of FIG. 3.
Figure 7:
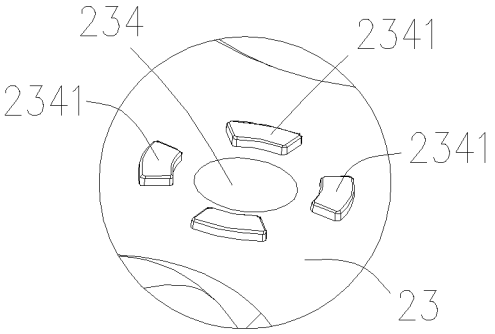
FIG. 7 is an enlarged view of a portion A in FIG. 3.

With reference to FIGS. 3, 6 and 7 at the same time, the cover plate 23 has a rectangular periphery, the width and length of which are both greater than the width and length of the circuit board 22, and optical lenses 236 are formed at positions opposite to the plurality of light sources 221 of the circuit board 22 so as to perform predetermined optical processing on the light transmitted from the light sources 221 to achieve a specific light effect. The cover plate 23 is preferably a chemically stable PC material. The long sides (length) of the front surface of the cover plate 23 is formed with grooves or steps 231 recessed from top to bottom (front to rear). Preferably, the groove or step 231 extends through one end of the long sides and does not extend through the other end of the long sides to function as a stopper. Positioning posts 232, 233 are formed on the rear surface of the cover plate 23 at positions corresponding to the positioning holes 2117, 2118. Two through holes 234 are formed at positions of the cover plate 23 corresponding to the screw holes 2119. A groove 235 for receiving a waterproof rubber ring 2351 is defined near the periphery of the cover plate 23, and surrounds all the lenses 236, the positioning posts 233 and the through holes 234. The positioning post 232 is located outside the groove 235, near the edge of the cover plate 23. The back surface of the cover plate 23 is further formed with two convex walls 237 each surrounding one through hole 234, and a waterproof silica gel ring 238 is provided inside each convex wall 237. The size of the through hole 223 of the circuit board 22 is larger than the outer diameter of the convex wall 237, and after the screw 239 passes through the through hole 234 and the through hole 223 and is screwed in the screw hole 2119 of the radiator 21, the end of the convex wall 237 and the waterproof silica gel ring 238 are in contact with the surface of the fixing surface 2111 of the radiator 21, and the inner side of the silica gel ring 238 is in contact with the outer side of the screw 239, thereby sealing the through hole 234 and the screw hole 2119, and preventing water vapor from entering the space defined by the cover plate 23 and the fixing surface 2111 of the radiator 21 through the through holes 234 and the screw holes 2119.

In the present embodiment, the fixed connection of the cover plate 23 and the radiator 21 is achieved by the fixture assembly 24 instead of pressing the cover plate 23 against the radiator by the screw 239. Therefore, after the screw 239 falls into the screw hole 2119, the nut 2391 thereof simply comes into contact with the surface of the cover plate 23. Meanwhile, as a double insurance, in order to prevent a stress concentration around the periphery of the through hole 234, the outer surface of the cover plate 23 is further formed with a plurality of protrusions 2341 (four in this embodiment), uniformly distributed on the outer periphery of the through hole 234 and spaced 0.05-0.25 cm from the edge of the through hole 234. After the screw 239 is screwed into the screw hole 2119 of the radiator 21 through the through holes of the cover plate and the circuit board, the nut 2391 of the screw 239 is only in contact with the plurality of protrusions 2341. As such, the force exerted by the screw 239 is dispersed by the plurality of protrusions 2341 onto the protrusions and the surrounding cover plate, avoiding the formation of a stress concentration at the edge of the through hole 234. Preferably, the convex wall 237 on the back side of the cover plate 23 at least partially coincides with the plurality of protrusions 2341 on the front side in a direction perpendicular to the fixing surface of the radiator, so that the stressed portion is thicker.

Figure 8:
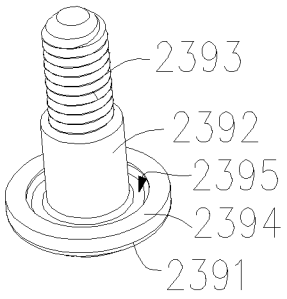
FIG. 8 is a perspective view of the screw of FIG. 6.

Further, as shown in FIG. 8, the screw 239 includes a nut 2391, an unthreaded section 2392 extending from the center of the rear surface of the nut, and a threaded section 2393 extending from the end of the unthreaded section. The threaded section 2393 corresponds to the screw hole 2119 in the radiator 21, and the outer diameter of the unthreaded section 2392 is larger than the outer diameter of the threaded section 2393. The distance between the threaded section 2393 and the position where the nut 2391 contacts the protrusion 2341 is equal to or greater than the distance between the fixing surface 2111 of the radiator and the surface of the protrusion 2341, so that it is ensured that the protrusion 2341 contacts the nut 2391 or has a gap therebetween after the threaded section 2393 is completely screwed into the screw hole 2119. In this embodiment, a collar 2394 is further formed at an edge of a rear surface of the nut 2391, a recess 2395 is formed at an inner side of the collar 2394, and the unthreaded section 2392 extends from a middle of the recess 2395. As such, it can be ensured that only the collar 2394 contacts the plurality of protrusions 2341 on the cover plate when the nut is in contact with the protrusions 2341.

Figure 9:
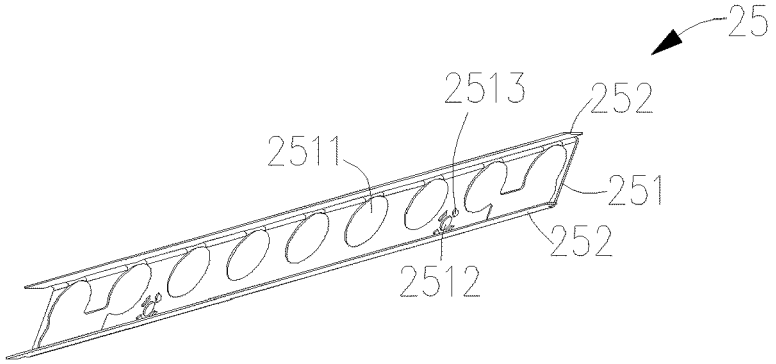
FIG. 9 is a schematic perspective view of a shade component in an embodiment.

The lighting fixture of the present invention may further include an optional shade component 25 as shown in FIG. 9, which may include a substantially rectangular fixing tab 251 and a reflector tab 252 extending from a length of the fixing tab 251. Vacancies 2511 are formed on the fixing plate 251 at positions corresponding to the lenses 236 of the cover plate 23, and vacancies 2512, 2513 are also formed at positions corresponding to the through holes 234 and the protrusions 2341. Further, the thickness of the fixing plate 251 is equal to or less than the height of the protrusion 2341 with respect to the surface of the cover plate 23. In use, screws 239 may be used to secure the shade component 25 to the cover plate 23. Because of the presence of the vacancy 2513, the nut 2391 of the screw 239 is only in contact with the protrusion 2341 or both the protrusion and the surface of the fixing plate 251. The reflector tab 252 is used for reflecting light transmitted from the cover plate 23 toward the shade component 25 to a preset direction at a preset angle to the fixing tab.

Figure 10:
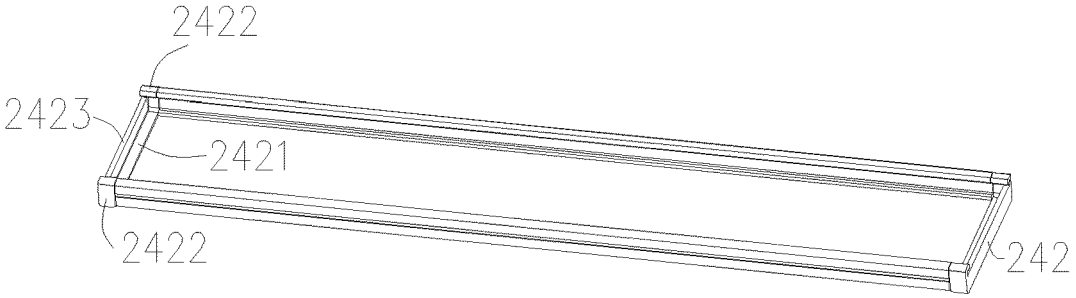
FIG. 10 is a perspective view from the rear side of the fixture of the light source module of FIG. 2.

The fixture assembly 24 is used for being connected with the radiator 21 to press the cover plate 23 on the radiator 21 in a manner that the cover plate is uniformly stressed on its periphery. With reference to both FIGS. 3 and 10, in this embodiment, the fixture assembly 24 includes two oppositely disposed first sliders 241 and two oppositely disposed second sliders 242. Each first slider 241 includes an elongated base plate 2411 and two sliding rails 2412 and 2413 extending from two long sides (lengths) of the base plate, wherein one sliding rail 2412 is inserted into a sliding slot 2114 on the side wall of the first heat transfer plate 211, and the other sliding rail 2413 is inserted into a groove or pressed on a step 231 of the cover plate 23 and pressed against the bottom of the groove or the step 231 downwards. By reasonably setting the width of the base plate 2411, the first slider 241 can press the cover plate on the radiator in a manner that two long sides of the cover plate are uniformly stressed. It will be appreciated that the two rails 2412, 2413 each have oppositely protruding portions for forming a snap-fit condition with a particular portion of the sliding slot 2114 and groove or step 231.

Each second slider 242 includes an elongated pressing plate 2421, two claws 2422 extending downward from both ends of the pressing plate, and a baffle 2423 extending from one of the long sides (lengths) of the pressing plate toward the radiator 21. The two claws 2422 of the second slider 242, similar to the sliding rails 2412 and 2413, are inserted into the two sliding slots 2114 of the first heat transfer plate 211, respectively, and by reasonably setting the size of the claws 2422, the pressing plate 2421 can press the short sides (width) of the cover plate 23 on the radiator 21 in a uniformly stressed manner. The baffle 2423 serves to perform a positioning function during assembly to prevent the second slide 242 from slipping out of position.

In addition, screws 214 and 215 pass through fixing holes 2115 and 2116 at both ends of the radiator 21 and are screwed into the screw holes 115 of the bracket 10 to fixedly connect the light source module 20 and the bracket 10. By setting the position of the fixing holes 2115, 2116 and the size of the nuts of the screws 214, 215, the second slider 242 is restrained, preventing the second slider 242 from being dislocated during long-term use.

Figure 11:
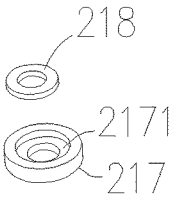
FIG. 11 is a perspective view of a gasket of the light source module of FIG. 2.
Figure 12:
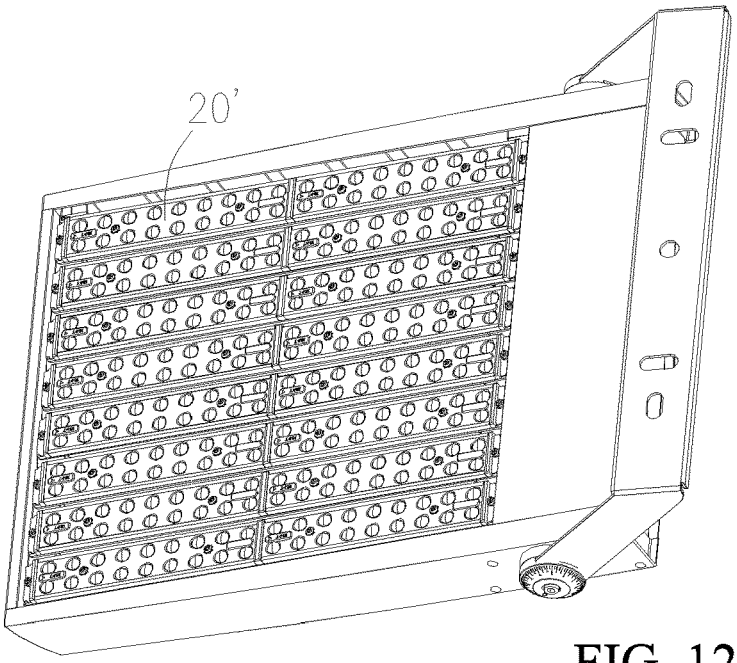
FIG. 12 is a perspective view of a lighting fixture in accordance with a second embodiment of the present invention.
Figure 13:
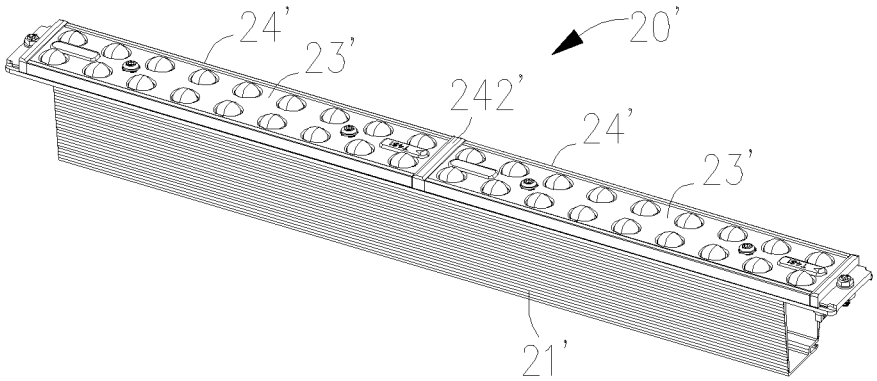
FIG. 13 is a perspective view of a light source module of the lighting fixture of FIG. 12.
Figure 14:
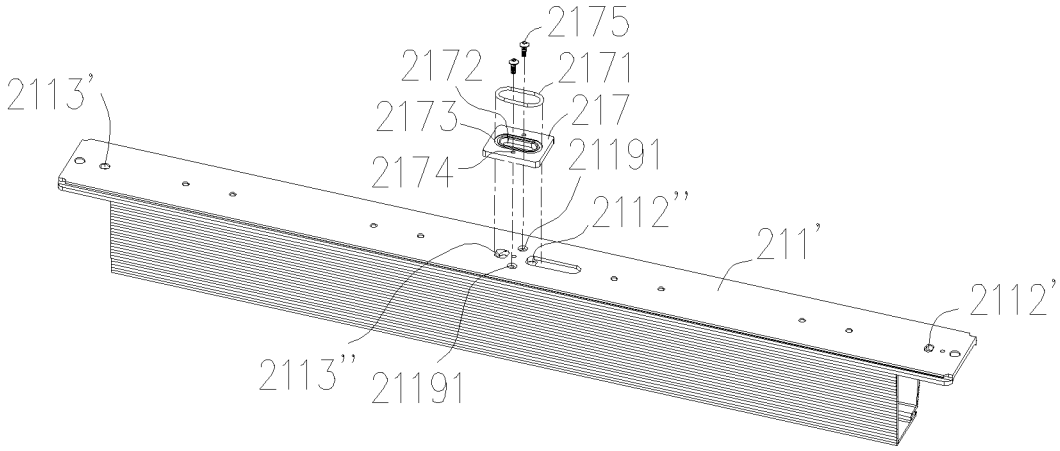
FIG. 14 is an exploded view of a radiator of the light source module of FIG. 13.
Figure 15:
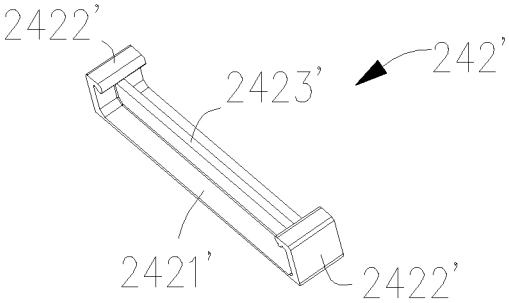
FIG. 15 is a perspective view from the rear side of one of the second sliders of the fixture of the light source module of FIG. 13.

In addition, the screws 214,215 are also sleeved with a gasket 217 as shown in FIG. 11, which is provided between the radiator 21 and the fixing pipe 11 of the bracket 10. The gasket 217 is made of a metal material, and a groove 2171 is formed on one surface of the gasket 217 facing the fixing pipe 11, and a non-metal gasket 218, preferably a rubber gasket, with a heat conductivity far lower than that of the metal material is arranged in the groove 2171. As such, after the light source module is connected to the bracket, heat is conducted between the light source module and the bracket only through the screws 241, 215 and the edge part of the gasket 217 surrounding the groove 2171, so that only a very small part of heat on the light source module is conducted to the bracket, and even if the bracket is provide with a power module, the power module cannot be influenced.

The light source module of the present invention seals the circuit board 23 in a sealed space defined by the cover plate 23 and the radiator 21 by means of the waterproof rubber ring 2351 provided inside the groove 235 below the cover plate 23, the waterproof silica gel ring 238 provided inside the convex wall 237, the rubber seat 32 provided in the wire hole 2112 of the radiator 21, and the sealing member 216 provided in the wire hole 2113 of the radiator 21. Since the cover plate is fixed on the radiator in a manner that the cover plate is uniformly stressed on its periphery, the cover plate is not easy to crack even if the cover plate becomes brittle due to exposure to an alkaline environment, and the use performance can be guaranteed. The screws 239 fixed to the cover plate are mainly used for fixing optional accessories, such as the shade component 25, and are not used for fastening the cover plate to the radiator in practical use, so that the nuts of the screws 239 are only in contact with the protrusions 2341 around the through holes of the cover plate, and even gaps are formed between the nuts and the protrusions 2341, thus the edges of the cover plate defining the through holes 234 do not crack due to stress concentration. Even if a certain force is applied to the protrusion 2341 by the screw 239 due to the product tolerance, the plurality of protrusions 2341 protruding from the surface of the cover plate can transmit the force to the periphery, reduce and eliminate the stress concentration, and prevent the cover plate from cracking.

In this embodiment, each light source module 20 includes one radiator 21, and one circuit board 22 and one cover plate 23 are fixed to the radiator 21 by a set of fixtures 24. Although two power wiring terminals 222, 222' are provided on the circuit board 22, only the power wiring terminal 222 is used to be connected to a power wire in the bracket, and the other power wiring terminal 222' is idle as a standard member. The wire hole 2113 of the radiator 21 corresponding to the power wiring terminal 222' may be sealed by a silica gel seal 216. The seal 216 may also serve as a pressurization port for the airtight test for the light source module 20.

With reference to FIGS. 12 to 15, in a modified second embodiment based on the above embodiment, a plurality of light source modules 20' are fixed in a bracket of another lighting fixture. Each light source module 20' includes one radiator 21', two circuit boards, two cover plates 23' and two fixture assemblies 24'. One of the two circuit boards and one of the two cover plates 23' are fixed to the radiator 21' by one of the two fixture assemblies 24'. The two circuit boards and the two cover plates 23' are identical to the circuit board 22 and the cover plate 23 in the first embodiment, and will not be described in detail. The radiator 21' differs from the radiator 21 in the first embodiment in that the length becomes longer, and four corresponding wire holes are provided corresponding to a total of four wire holes in the two circuit boards, wherein two wire holes 2112' and 2113' near both ends are respectively used for passing a power wire and inserting a sealing member similar to the sealing member 216 of first embodiment. Two wire holes 2112" and 2113" near the middle are respectively used for passing through wires connecting adjacent circuit boards. Two through holes 21191 are also formed between the wire holes 2112" and 2113". Similar to the first embodiment, the two wire holes 2112" and 2113" are respectively located inside the sealing rubber ring under the two cover plates 23', so that the openings of the wire holes 2112" and 2113" at the front face of the radiator 21' are located in the sealed space of the cover plates 23'. The through holes 21191 are located outside the sealing rubber rings under the two cover plates 23'. The openings of the wire holes 2112" and 2113" on the back surface of the first heat transfer plate 211' of the radiator 21' are sealed by a sealing block 217 and a matched sealing rubber ring 2171. Specifically, the sealing block 217 is an aluminum plate made of the same material as that of the radiator, the surface thereof facing the back surface of the first heat transfer plate 211' forming a groove 2172 for passing a wire, and also forming an annular groove 2173 surrounding the groove 2172. A sealing ring 2171 is disposed within the groove 2173. A screw hole 2174 is formed outside the groove 2173. The sealing block 217 may be fixed to the rear surface of the first heat transfer plate 211' by screws 2175, thereby sealing the openings of the wire holes 2112" and 2113" at the rear surface of the first heat transfer plate 211' of the radiator 21'. One end of a connection wire for electrically connecting adjacent circuit boards is connected with one power wiring terminal of one of the circuit boards and then extends from a nearby wire hole 2112' or 2113' to the back surface of the radiator 21', and extends from the other wire hole 2113' or 2112' to and is connected with one power wiring terminal of the other circuit board.

The fixture assembly 24' is similar to the fixture assembly 24 of the first embodiment, except that the two fixture assemblies 24' share one second sliding member 242', and the short sides (widths) of the adjacent cover plates 23' are pressed tight by one second sliding member 242', so that the cover plates are pressed against the radiator in such a manner that the two short sides of the cover plates are uniformly stressed. Specifically, the second slider 242' includes an elongated pressing plate 2421' having a wider width, two claws 2422' extending downward from both ends of the pressing plate, and a baffle 2423' extending from the middle of the pressing plate toward the radiator 21' between the two cover plates 23'. The baffle 2423' divides the elongated pressing plate 2421' and the claw 2422' into left and right for pressing down the short sides of the adjacent cover plates 23', respectively.

Therefore, when the modular circuit board and the cover plate need to be expanded, only the size of the radiator needs to be adjusted and the sealing block is provided. It will be appreciated that in other variations, three or more sets of circuit boards and cover plates may be provided on each radiator.

It will be appreciated that in other embodiments, the collar 2394 on the back of the nut 2391 of the screw 239 may be replaced by a plurality of protrusions distributed along a circle centered on the unthreaded section.

It will be appreciated that in other embodiments, the radiator may be of other shapes, so long as it has a flat fixing surface to which a cover plate may be fixed. For example but not limited, the radiator may include a heat transfer plate having one surface as a mounting face and a plurality of heat dissipation fins formed on the other surface.

It will be appreciated that in other embodiments, the two first sliders in the fixture assembly may be fixedly connected to the radiator. That is, the sliding slot on the radiator is eliminated, and one first slider in the first slider is fixedly connected with the long side of the radiator or integrally formed with the long side of the radiator, so that the two first sliders are deformed into two sliding slots which are oppositely arranged, and the cover plate needs to be inserted between the two first sliders from one end of the sliding slot to be fixed. In this way, the cover plate can be pressed against the radiator in a manner that the cover plate is uniformly stressed on its periphery.

It will be appreciated that in other embodiments, only one power wiring terminal may be provided on the circuit board for electrical connection to a power wire within the light fixture. In this case, only one circuit board and one cover plate are provided on each radiator.

It will be appreciated that the above bolting preferably uses a spacer or washer, and that the face of the spacer or washer in contact with the mounting face preferably fits over the mounting face, thereby strengthening the connection.

While the invention has been described in terms of several exemplary embodiments, those skilled on the art will recognize that the invention can be practiced with modification within the spirit and scope of the appended claims. In addition, it is noted that, the Applicant's intent is to encompass equivalents of all claim elements, even if amended later during prosecution.

What is claimed is:

1. A lighting fixture, comprising:

a bracket;

at least one light source module assembled on an inner side of the bracket, each light source module comprising:

a radiator;

a circuit board with a rear surface contacting the radiator and a front surface being provided with a plurality of light sources; and a cover plate defining a plurality of optical lenses; and a fixture assembly removably connected with the radiator and pressing the cover plate on the radiator in a manner that the cover plate is uniformly stressed on its periphery, wherein the radiator defines two or more screw holes therethrough, the cover plate and the circuit board also defines two or more through holes corresponding to the two or more screw holes; a plurality of protrusions on a periphery of each through hole in the cover plate, and the plurality of protrusions are formed on an outer surface of the cover plate; when a screw passes through corresponding through holes in the cover plate and the circuit board and is screwed into a corresponding screw hole in the radiator, a gap exists between a screw nut and the plurality of protrusions or the screw nut only contacts with the plurality of protrusions.

2. The lighting fixture according to claim 1, wherein the plurality of protrusions are spaced a predetermined distance from an edge defining the through hole.

3. The lighting fixture according to claim 1, wherein the screw comprises:

the screw nut;

an unthreaded section having an unthreaded periphery extending from a center of a back surface of the screw nut; and a threaded section having a threaded periphery extending from a tail end of the unthreaded section;

wherein the threaded section corresponds to a screw hole on the radiator, and an outer diameter of the unthreaded section is larger than an outer diameter of the threaded section; a distance between the threaded section and a position where the nut is in contact with the protrusion is equal to or greater than a distance from a surface of the radiator in contact with the circuit board to an upper surface of the protrusion.

4. The lighting fixture according to claim 3, wherein a collar or a plurality of convex parts distributed along a circle having the unthreaded section as a center are formed on the back surface of the nut, a recess is formed on an inner side of the collar or the plurality of convex parts, the unthreaded section extends from the middle of the recess, and the collar or the plurality of convex parts are in contact with the plurality of convex parts on the cover plate.

5. The lighting fixture according to claim 4, wherein each light source module further comprises: one more circuit board and one more cover plate; each cover plate seals a corresponding one of the circuit boards between the cover plate and the radiator through a sealing rubber ring and a fixture assembly; two power wiring terminals are arranged on each circuit board, and two wire holes are defined in the radiator at positions respectively close to the two power wiring terminals; one end of a connecting wire used for electrically connecting adjacent circuit boards is connected with one power wiring terminal of one of the circuit boards and then extends from a nearby wire hole to the back surface of the radiator, and extends from the other wire hole to one power wiring terminal of the other circuit board and is connected therewith; a sealing block used for sealing the connecting wire and the corresponding wire hole is fixed on the back surface of the radiator, an annular groove used for accommodating a sealing rubber ring is formed in the sealing block, and the sealing block is fixed on the back surface of the radiator through the sealing rubber ring and screws to seal the connecting wire and the corresponding wire hole.

6. The lighting fixture according to claim 4, wherein a power wiring terminal is configured on the circuit board, a wire hole is defined in the radiator at a position close to the power wiring terminal, a power wire passes through the wire hole through a sealing rubber seat, and the tail end of the power wire is connected with a first electric connector; a guide rubber seat is further fixed on the power wire between the first electric connector and the sealing rubber seat; the guide rubber seat is cylindrical, and a trim is formed at one end close to the sealing rubber seat; a wire hole corresponding to the wire hole on the radiator is defined in the bracket, and the size of the wire hole on the bracket is smaller than that of the trim.

7. The lighting fixture according to claim 5, wherein a tail end of a power wire in the bracket is connected with a second electric connector, a rubber block is fixed at a position close to the second electric connector, and a plurality of fingers which simultaneously extend to an outer side and away from the second electric connector are formed on a peripheral wall of the rubber block; a size of the outer periphery of the rubber block is smaller than or equal to a size of the wire hole, and an outward extending size of the finger is larger than the size of the wire hole; under an action of external force, the rubber block and the fingers can pass through the wire hole.

8. The lighting fixture according to claim 4, wherein the radiator comprises:

a substantially rectangular first heat transfer plate contacting a rear surface of the circuit board;

two second heat transfer plates extending from two side edges of the rear surface of the first heat transfer plate; and a third heat transfer plate connecting tail ends of the two second heat transfer plates;

wherein each long side wall of the first heat transfer plate defines a sliding slot with both ends open, and each long edge on a front surface of the cover plate defines a groove or a step recessed downwards accordingly;

wherein the fixture assembly comprises:

two oppositely arranged first sliders each comprising a strip base plate and two sliding rails respectively extending from two long edges of the base plate; and two oppositely arranged second sliders each comprising an elongated pressing plate and two claws extending downwards from two ends of the pressing plate;

wherein one sliding rail of each first slider is inserted into one sliding slot on the first heat transfer plate, the other sliding rail of each first slider is pressed against one groove or one step of the cover plate from top towards bottom, such that the cover plate is pressed against the radiator in a manner that the cover plate is uniformly stressed along its two long edges;

wherein the two claws of each second slider are respectively inserted into two sliding slots of the first heat transfer plate, and the pressing plate presses a short edge of the cover plate against the radiator in a uniformly stressed manner.

9. The lighting fixture according to claim 8, wherein the second slider further comprises a baffle extending from the pressing plate toward the radiator.

10. The lighting fixture according to claim 8, wherein each light source module further comprises: one more circuit board and one more cover plate; each cover plate seals a corresponding one of the circuit boards between the cover plate and the radiator through a sealing rubber ring and a fixture assembly; two power wiring terminals are arranged on each circuit board, and two wire holes are defined in the radiator at positions respectively close to the two power wiring terminals; one end of a connecting wire used for electrically connecting adjacent circuit boards is connected with one power wiring terminal of one of the circuit boards and then extends from a nearby wire hole to the back surface of the radiator, and extends from the other wire hole to one power wiring terminal of the other circuit board and is connected therewith; a sealing block used for sealing the connecting wire and the corresponding wire hole is fixed on the back surface of the radiator, an annular groove used for accommodating a sealing rubber ring is formed in the sealing block, and the sealing block is fixed on the back surface of the radiator through the sealing rubber ring and screws to seal the connecting wire and the corresponding wire hole.

11. The lighting fixture according to claim 8, wherein at least one of the second heat transfer plates defines a groove at a position close to the third heat transfer plate.

12. A light source module, comprising:

a radiator;

a circuit board with a rear surface contacting the radiator and a front surface being provided with a plurality of light sources;

a cover plate defining a plurality of optical lenses; and a fixture assembly removably connected with the radiator and pressing the cover plate on the radiator in a manner that the cover plate is uniformly stressed on its periphery, wherein the radiator defines two or more screw holes therethrough, the cover plate and the circuit board also defines two or more through holes corresponding to the two or more screw holes; a plurality of protrusions on a periphery of each through hole in the cover plate, and the plurality of protrusions are formed on an outer surface of the cover plate; when a screw passes through corresponding through holes in the cover plate and the circuit board and is screwed into a corresponding screw hole in the radiator, a gap exists between a screw nut and the plurality of protrusions or the screw nut only contacts with the plurality of protrusions.

13. The light source module according to claim 12, wherein the plurality of protrusions are spaced a predetermined distance from an edge defining the through hole.

14. The light source module according to claim 12, wherein the screw comprises:

the screw nut;

an unthreaded section having an unthreaded periphery extending from a center of a back surface of the screw nut; and a threaded section having a threaded periphery extending from a tail end of the unthreaded section;

wherein the threaded section corresponds to a screw hole on the radiator, and an outer diameter of the unthreaded section is larger than an outer diameter of the threaded section; a distance between the threaded section and a position where the nut is in contact with the protrusion is equal to or greater than a distance from a surface of the radiator in contact with the circuit board to an upper surface of the protrusion.

15. The light source module according to claim 14, wherein a collar or a plurality of convex parts distributed along a circle having the unthreaded section as a center are formed on the back surface of the nut, a recess is formed on an inner side of the collar or the plurality of convex parts, the unthreaded section extends from the middle of the recess, and the collar or the plurality of convex parts are in contact with the plurality of convex parts on the cover plate.

16. The light source module according to claim 15, wherein each light source module further comprises: one more circuit board and one more cover plate; each cover plate seals a corresponding one of the circuit boards between the cover plate and the radiator through a sealing rubber ring and a fixture assembly; two power wiring terminals are arranged on each circuit board, and two wire holes are defined in the radiator at positions respectively close to the two power wiring terminals; one end of a connecting wire used for electrically connecting adjacent circuit boards is connected with one power wiring terminal of one of the circuit boards and then extends from a nearby wire hole to the back surface of the radiator, and extends from the other wire hole to one power wiring terminal of the other circuit board and is connected therewith; a sealing block used for sealing the connecting wire and the corresponding wire hole is fixed on the back surface of the radiator, an annular groove used for accommodating a sealing rubber ring is formed in the sealing block, and the sealing block is fixed on the back surface of the radiator through the sealing rubber ring and screws to seal the connecting wire and the corresponding wire hole.

17. The light source module according to claim 15, wherein the radiator comprises:

a substantially rectangular first heat transfer plate contacting a rear surface of the circuit board;

two second heat transfer plates extending from two side edges of the rear surface of the first heat transfer plate; and a third heat transfer plate connecting tail ends of the two second heat transfer plates;

wherein each long side wall of the first heat transfer plate defines a sliding slot with both ends open, and each long edge on a front surface of the cover plate defines a groove or a step recessed downwards accordingly;

wherein the fixture assembly comprises:

two oppositely arranged first sliders each comprising a strip base plate and two sliding rails respectively extending from two long edges of the base plate; and two oppositely arranged second sliders each comprising an elongated pressing plate and two claws extending downwards from two ends of the pressing plate;

wherein one sliding rail of each first slider is inserted into one sliding slot on the first heat transfer plate, the other sliding rail of each first slider is pressed against one groove or one step of the cover plate from top towards bottom, such that the cover plate is pressed against the radiator in a manner that the cover plate is uniformly stressed along its two long edges;

wherein the two claws of each second slider are respectively inserted into two sliding slots of the first heat transfer plate, and the pressing plate presses a short edge of the cover plate against the radiator in a uniformly stressed manner.

18. The light source module according to claim 17, wherein the second slider further comprises a baffle extending from the pressing plate toward the radiator.

* * * * *